US011268415B2

(12) United States Patent
Shwan et al.

(10) Patent No.: US 11,268,415 B2
(45) Date of Patent: Mar. 8, 2022

(54) METHOD FOR CONTROLLING THE TEMPERATURE OF A NOX CONTROLLING COMPONENT AND AN EXHAUST AFTER TREATMENT SYSTEM

(71) Applicant: VOLVO TRUCK CORPORATION, Gothenburg (SE)

(72) Inventors: Soran Shwan, Mölndal (SE); Lars Carlhammar, Lindome (SE); Fredrik Blomgren, Hisings Kärra (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 16/615,273

(22) PCT Filed: Jun. 2, 2017

(86) PCT No.: PCT/EP2017/063512
§ 371 (c)(1),
(2) Date: Nov. 20, 2019

(87) PCT Pub. No.: WO2018/219476
PCT Pub. Date: Dec. 6, 2018

(65) Prior Publication Data

US 2020/0173325 A1 Jun. 4, 2020

(51) Int. Cl.
*F01N 3/08* (2006.01)
*F01N 3/20* (2006.01)
(Continued)

(52) U.S. Cl.
CPC ..... *F01N 3/0842* (2013.01); *F01N 3/2066* (2013.01); *F01N 3/0814* (2013.01);
(Continued)

(58) Field of Classification Search
CPC combination set(s) only.
See application file for complete search history.

(56) References Cited

U.S. PATENT DOCUMENTS 5,628,186 A * 5/1997 Schmelz ..... B01D 53/9495 60/274
5,653,106 A * 8/1997 Katashiba ..... F28D 20/0034 60/300
(Continued)

FOREIGN PATENT DOCUMENTS

CN 103925050 A 7/2014
DE 10206066 A1 9/2002
(Continued)

OTHER PUBLICATIONS

International Search Report and Written Opinion in corresponding International Application No. PCT/EP2017/063512 dated Feb. 8, 2018 (16 pages).
(Continued)

*Primary Examiner* — Binh Q Tran
(74) *Attorney, Agent, or Firm* — Venable LLP; Jeffri A. Kaminski

(57) ABSTRACT

The invention relates to a method for controlling the temperature of an NOx controlling component in an exhaust after treatment system of an internal combustion engine. The NOx controlling component has inner surface portions defining an interior component space through which exhaust gases are arranged to flow in order to be NOx controlled, and has outer surface portions facing away from the interior component space. The method comprises the step of: controlling the temperature of at least a portion of the NOx controlling component by a heat transfer medium arranged outside of the outer surface portions. The invention also relates to an exhaust after treatment system and a vehicle with such a system.

12 Claims, 6 Drawing Sheets

(51) Int. Cl.
*F01N 3/10* (2006.01)
*F01N 9/00* (2006.01)

(52) U.S. Cl.
CPC ..... *F01N 3/106* (2013.01); *F01N 9/00* (2013.01); *F01N 2560/026* (2013.01); *F01N 2570/14* (2013.01)

(56) References Cited

U.S. PATENT DOCUMENTS

| | | | | |
|---|---|---|---|---|
| 5,753,188 | A * | 5/1998 | Shimoda | F01N 3/2046 422/108 |
| 7,803,338 | B2 * | 9/2010 | Socha | F01N 13/0097 423/239.1 |
| 8,341,946 | B2 * | 1/2013 | Harmsen | B01D 53/944 60/297 |
| 8,475,754 | B2 * | 7/2013 | Eigenberger | F01N 3/2006 423/213.2 |
| 10,655,520 | B2 * | 5/2020 | Kruger | F01N 3/021 |
| 2005/0126158 | A1 * | 6/2005 | Benz | B01D 53/9431 60/275 |
| 2007/0209350 | A1 * | 9/2007 | Johansen | B01D 53/945 60/289 |
| 2011/0131962 | A1 * | 6/2011 | Toi | F01P 3/12 60/320 |
| 2015/0377102 | A1 | 12/2015 | Yezerets et al. | |
| 2016/0076419 | A1 * | 3/2016 | Roy | F01N 3/101 60/274 |
| 2018/0119591 | A1 * | 5/2018 | Everly | H05B 3/48 |

FOREIGN PATENT DOCUMENTS

| | | | |
|---|---|---|---|
| DE | 10206066 | B4 | 5/2005 |
| EP | 3103978 | A1 | 12/2016 |
| JP | H07279653 | A | 10/1995 |
| JP | 2003286832 | A | 10/2003 |

OTHER PUBLICATIONS

China Office Action dated May 11, 2021 in corresponding China Patent Application No. 201780090508.7, 12 pages.

* cited by examiner

METHOD FOR CONTROLLING THE TEMPERATURE OF A NOX CONTROLLING COMPONENT AND AN EXHAUST AFTER TREATMENT SYSTEM

CROSS-REFERENCE TO RELATED APPLICATIONS

This application is a U.S. National Stage application of PCT/EP2017/063512, filed Jun. 2, 2017 and published on Dec. 6, 2018 as WO/2018/219476, all of which is hereby incorporated by reference in its entirety.

TECHNICAL FIELD

The invention relates to a method for controlling the temperature of a NOx controlling component in an exhaust after treatment system of an internal combustion engine. The invention also relates to an exhaust after treatment system comprising a NOx controlling component and a vehicle being provided with such an exhaust after treatment system.

The invention can be applied in heavy-duty vehicles, such as trucks, buses and construction equipment. Although the invention will be described with respect to a truck, the invention is not restricted to this particular vehicle, but may also be used in other vehicles such as other heavy-duty vehicles and automobiles.

BACKGROUND

Vehicles, such as e.g. trucks and buses, are typically equipped with an exhaust after treatment system, commonly abbreviated as EATS, located downstream of the engine and being configured to reduce emissions originating from the exhaust gases from the engine. An EATS may comprise different types of components with the purpose to reduce different type of emissions, and is often related to the type of engine used in the vehicle. For example, an EATS connected to a diesel engine often comprises a NOx controlling component in order to control the NOx. The NOx can be controlled by various means, for example by controlling the NO2/NOx ratio in e.g. a diesel oxidation catalyst, DOC, component. The DOC component typically comprises a catalyst material such as e.g. palladium, platinum and/or aluminium oxide, all of which serve to oxidize nitrogen components such as NOx to form at least NO2, and to oxidize hydrocarbons and carbon monoxide to form carbon dioxide and water. In another example, the EATS may comprise a component that at least temporarily adsorbs or stores the nitrogen based emissions, such as NOx emissions, in a so called NOx adsorber or NOx trap. Moreover, nitrogen based emissions may be treated in a selective catalytic reduction (SCR) component, in which a reagent such as ammonia is used to reduce the NOx into nitrogen. Ammonia is typically supplied to the EATS by the injection of urea into the exhaust, which then undergoes thermal decomposition and hydrolysis into ammonia. The EATS often also comprises a filter, such as a particulate filter, for reducing soot in the exhaust gases. The cleaned, or at least emission reduced, exhaust gases then leaves the EATS and the vehicle through the tailpipe of the vehicle.

Government regulations impose strict limits for emissions from vehicles, e.g. upcoming emission legislation such as e.g. CARB Ultra Low NOx, that is planned to be in force around 2024-2025. This, together with a constant demand for increased fuel economy of the vehicle, implies a need for a more efficient and durable EATS. One mode of operation that is subject to improvement with regards to emissions is cold-start of the engine (i.e. operation of the engine, and the EATS, prior to the working temperature of the components have been reached).

US 2015/0377102 deals with NOx emissions from a vehicle, and addresses the problem with these emissions during cold-start. According to the abstract, US 2015/0377102 discloses: An internal combustion engine system includes an engine and an aftertreatment system that is connected to the engine to receive exhaust flow from the engine. The aftertreatment system includes a passive storage device for passively storing NOx and/or hydrocarbons produced by the engine during cold start and low temperature operating conditions, and a NOx reduction catalyst downstream of the passive storage device for receiving the NOx released from the passive storage device when temperature conditions in the exhaust flow and/or NOx reduction catalyst are above an effective temperature for NOx reduction. Diagnostics of the passive storage device and/or a sensor downstream of the passive storage device are contemplated that are based at least in part on an expected sensor output in response to a storage mode of operation or a release mode of operation of the passive storage device. Furthermore, reductant injection control is provided in response to a NOx amount released from the passive storage device.

However, the system in US 2015/0377102 is relatively complex, and there is thus a need in the industry for a simpler but yet effective system handling the emissions from the vehicle.

SUMMARY

In view of the above-mentioned and other drawbacks of the prior art, the object of the present inventive concept is to provide an improved control of the temperature of an NOx controlling component in an exhaust after treatment system.

According to a first aspect of the invention, the object is achieved by a method for controlling the temperature of a NOx controlling component in an exhaust after treatment system of an internal combustion engine according to claim 1. The NOx controlling component has inner surface portions defining an interior component space through which exhaust gases are arranged to flow in order to be NOx controlled, and has outer surface portions facing away from said interior component space. The method comprises the step of:

controlling the temperature of at least a portion of said NOx controlling component by a heat transfer medium arranged outside of said outer surface portions.

By the provision of having a heat transfer medium arranged outside of the outer surface portions of the NOx controlling component, an effective way of controlling the temperature of at least a portion of the NOx controlling component is provided. Moreover, having a heat transfer medium arranged outside of the outer surface portions of the NOx controlling component, allows the exhaust after treatment system to be temperature controlled without e.g. direct mixing of the exhaust gases with a hot or cool gas, and hereby the components in the EATS downstream of the NOx controlling component can be kept relatively unaffected.

It should be understood that the term "controlling" the temperature of at least a portion of the NOx controlling component, comprises heating and/or cooling of said at least portion of the NOx controlling component. Thus, it should be understood that the method according to the invention may comprise both cooling and heating of the NOx controlling component via the outer surface portions. The choice of heating and/or cooling depends on e.g. the mode of operation of the vehicle and e.g. the type and operational mode of the NOx controlling component. For example, for at least one mode of operation, e.g. cold-start of the engine, and for a NOx controlling component functioning as a NOx trap or NOx adsorber, the NOx controlling component may be subject to cooling in order to delay release of any emissions adsorbed by the NOx controlling component, until the working temperature of other components in the EATS have been reached (e.g. until the working temperature of an SCR component in the EATS has been reached). According to another example, for at least one other mode of operation, the NOx controlling component is heated in order to improve the NO2/NOx ratio.

It should be noted that sensors, control units, diagnosis methods etc. known in the art, and which for example is described in US 2015/0377102, typically is used to determine the mode of operation and whether the NOx controlling component should be subject to heating or cooling. For example, the EATS comprises at least one sensor configured to detect and measure the amount of NO, NOx, CO, CO2, other hydrocarbons, and/or O2. Moreover, the EATS may comprise at least one control unit connected to said at least one sensor, and configured to analyse and diagnose the emission condition and/or the mode of operation of the vehicle. Furthermore, the control unit may be connected to valves, such as e.g. shut-off valves, or other components in the EATS, in order to control the heating and/or cooling of the NOx controlling component.

It should be understood that the outer surface portions of the NOx controlling component may be referred to as the jacket of the NOx controlling component. Moreover, it should be understood that the when stating that "at least a portion of said NOx controlling component "is temperature controlled, the heat transfer medium is in thermal contact with the outer surface portions along at least a portion of the length of the NOx controlling component. Thus, the interior component space, located closest to the outer surface portions being subject to the heat transfer medium, is typically subject to the majority of the temperature control. According to one embodiment, the method comprises the step of controlling the temperature of said NOx controlling component, such as e.g. the whole of said NOx controlling component, by a heat transfer medium arranged outside of said outer surface portions. For example, the heat transfer medium may be arranged to be in thermal contact with the outer surface portions, along the entire length of the NOx controlling component.

According to one embodiment, heat is received from, or released to, the interior component space of the NOx controlling component via said outer surface portions which, e.g. are comprised in the outer walls of the NOx controlling component. Thus, for at least a part of the heat transfer, heat is conducted through at least a portion of the NOx controlling component, such as e.g. conducted through the outer walls.

It should be understood that the heat transfer medium is arranged to release heat to (heating), or receive heat from (cooling), said NOx controlling component. Thus, the NOx controlling component, such as the interior component space, is heated or cooled by means of said heat transfer medium.

According to one embodiment, said NOx controlling component is a diesel oxidation catalyst (DOC) component, or a NOx adsorber, e.g. a passive NOx adsorber (PNA), a lean NOx trap (LNT), or another type of NOx adsorber.

Hence, the NOx controlling component is commonly referred to a component of the EATS that by some means controls the NOx, e.g. by at least temporarily adsorb or store the NOx and/or by oxidizing the NOx to form at least NO2. Hence, and according to one embodiment, the term "in order to be NOx controlled" means that the NOx controlling component controls the NOx by at least temporarily adsorbing the NOx, storing the NOx and/or oxidizing the NOx. According to one embodiment, the DOC component comprises an active component adapted to adsorb or store the NOx, and hence the NOx controlling component may be referred to as a DOC with NOx adsorbing capability.

According to one embodiment, said step of controlling the temperature comprises directing a flow of said heat transfer medium to flow over said outer surface portions of said NOx controlling component.

Hereby, the heat transfer medium may transfer heat to the outer surface portions by at least partly convective heat transfer, thus providing an efficient heat transfer process between the heat transfer medium and the NOx controlling component. It should be noted that the heat transfer medium may flow over only a portion of said outer surface portions of the NOx controlling component, such as e.g. flow over up to 50%, or 70%, or 90% of the outer surface portions. According to one embodiment, the heat transfer medium is arranged to flow over the outer surface portions along the entire circumference of the NOx controlling component.

According to one embodiment, said step of controlling the temperature comprises cooling at least a portion of said NOx controlling component by said heat transfer medium.

That is, the heat transfer medium receives heat from outer surface portions of the NOx controlling component, and thereby cools the NOx controlling component. For example, the heat transfer medium may receive the heat as it flows over the outer surface portions of the NOx controlling component. This may e.g. be used when it is desirable to delay any release of substances adsorbed or stored by the NOx controlling component (e.g. a NOx adsorber), and which should be released when the working temperature of other components in the EATS have been reached.

According to one embodiment the method comprises the further step of bleeding a sub portion of the exhaust gases downstream of said NOx controlling component, and using said sub portion to form at least a part of said heat transfer medium.

Hereby, a relatively simple means for providing at least a part of the heat transfer medium is provided. It should be understood that downstream of the NOx controlling component, the exhaust gases are typically cooler compared to upstream of the NOx controlling component due to heat dissipation to the surroundings, and heat released to other components in the EATS, such as e.g. a selective catalytic reduction (SCR) component. Thus, by bleeding a sub portion of the exhaust gases downstream of the NOx controlling component, a relatively cool stream of gases is provided, which relatively cool stream can be used to receive heat from the NOx controlling component. Thus, it should be understood that the sub-portion of the exhaust gases bled downstream of the NOx controlling component, is used to form at least a part of said heat transfer medium which flows over said outer surface portions of said NOx controlling component. The sub-portion of the exhaust gases may e.g. be bled downstream of an SCR component in the EATS.

According to one embodiment, the method comprises the further step of using external cooling gas such as e.g. ambient air to form at least a part of said heat transfer medium.

Thus, an effective but yet relatively cheap way of providing at least a part of the heat transfer means is provided. It should be understood that the external cooling gas is used to form at least a part of said heat transfer medium which flows over said outer surface portions of said NOx controlling component. The external cooling gas, may e.g. be mixed with said sub portion of the exhaust gases bled downstream of the NOx controlling component, prior to being subject for heat transfer with said outer surface portions of the NOx controlling component.

The external cooling gas may e.g. be used as a boost of cooling during cold start of the engine and/or cooling during normal operation when the EATS is warm.

According to one embodiment, said step of controlling the temperature comprises heating at least a portion of said NOx controlling component by said heat transfer medium.

That is, the heat transfer medium releases heat to said outer surface portions of the NOx controlling component, and thereby heats the NOx controlling component. For example, the heat transfer medium may release the heat as it flows over the outer surface portions of the NOx controlling component.

According to one embodiment, the EATS comprises means for heating and cooling at least a portion of said NOx controlling component by a heat transfer medium arranged outside of said outer surface portions. That is, the means is configured to enable both heating and cooling, either subsequently or simultaneously, for at least a portion of said NOx controlling component by a heat transfer medium arranged outside of said outer surface portions. For example, cooling of the NOx controlling component may be desirable during some mode of operations, e.g. during cold-start of the engine to delay release of any substances adsorbed or stored in the NOx controlling component, and heating during other modes of operation when e.g. the NO/NOx ration should be improved. For example, if the NOx controlling component is lean NOx trap, LNT, a quick rise in temperature is desirable which may be carried out by an initial heating of the LNT. After the LNT has reached the desired temperature, i.e. its working temperature, it is desirable to hold this temperature, which e.g. may be carried out by subsequent cooling of the LNT to remove any excess heat.

According to one embodiment, the method comprises the further step of heating a fluid in a heating line by a burner, and using said heated fluid to form at least a part of said heat transfer medium.

That is, the heating line comprises a heating fluid, which is heated by the burner, and which is in fluid connection with said outer surface portions of said NOx controlling component. Thus, an effective but yet relatively cheap way of providing at least a part of the heat transfer means is provided. It should be understood that the heating fluid is used to form at least a part of said heat transfer medium which flows over said outer surface portions of said NOx controlling component.

According to one embodiment, heat upstream of the NOx controlling component is used, either by heat exchange or direct mixing via a bleeding sub-portion of the exhaust gases, as at least a part of the heat transfer medium.

According to one embodiment, wherein said step of controlling the temperature comprises receiving heat from, or releasing heat to, said NOx controlling component by a phase change of said heat transfer medium.

Thus, an alternate way to letting said heat transfer medium flow over said outer surface portions of said NOx controlling component, is provided. Thus, the heat transfer medium has been chosen to be a phase change heat transfer medium, that is, a heat transfer medium which is adapted to the temperature range of the NOx controlling component, and to desired temperature change of the NOx controlling component.

For example, by cooling the NOx controlling component with a phase change, the heat transfer medium will keep the NOx controlling component cold as long as the heat transfer medium has capacity to adsorb the heat. This may e.g. delay the heating of the NOx controlling component as the EATS system is heated to its working temperature.

According to one embodiment, the method comprises the further step of heating the NOx controlling component by adding heat to the exhaust gases upstream of said NOx controlling component.

Thus, the process of controlling the NOx controlling component by a heat transfer medium arranged outside of the outer surface portions of the NOx controlling component, can be combined with adding heat to exhaust gases, e.g. by a heat exchanger, a turbo by-pass, and/or mixing of a heating gas with the exhaust gases, upstream of the NOx controlling component. Hereby, the temperature of the NOx controlling component can be controlled by different means.

In the following sections, more detailed examples of NOx controlling components are described.

For example, the NOx controlling component may be a passive NOx adsorber (PNA), potentially together with the functionality of a DOC. A PNA adsorbs or stores incoming NOx when the temperature is relatively low (i.e. it is relatively cold) and releases the stored NOx when the temperature raises and passes a threshold temperature (typically about 180° C.). The use of a PNA in an exhaust after treatment system is more effective if the stored NOx is released from the PNA when the downstream located SCR component has reached its working temperature. A problem with prior use of a PNA in an EATS is that the SCR component has not reached its working temperature when the PNA passes the threshold temperature, and the SCR component is thus too cold to handle the incoming NOx. However, by controlling the temperature of the PNA by arranging a heat transfer medium outside of the outer surface portions of the PNA, the release of the stored NOx can be efficiently delayed until the SCR component has reached its working temperature, and thus can handle the NOx efficiently.

For embodiments where the NOx controlling component is an oxidation catalyst component, such as a DOC, the NO2/NOx ratio from the DOC is preferable controlled such that it is around 0.5 when it reaches the SCR component (this is due to the so-called desired fast SCR reaction). The NO2/NOx ration is temperature dependent, and is thus controlled by the temperature as know by the skilled person. If the NO2/NOX ratio can be kept at 0.5, iron based catalyst in the SCR component can be used, e.g. iron-exchanged zeolites, which are very active during fast SCR reaction compared to other SCR catalyst. Hereby, the size of the SCR component can be reduced for the same efficiency. Moreover, controlling the NO2/NOx ratio can further improve the passive soot regeneration in the filter (e.g. a diesel particulate filter, DPF) where high NO2 concentrations are preferable.

Thus, it should be understood that cooling the NOx controlling component may help to increase the efficiency of the EATS by decreasing NOx emissions. For example, during cold starts of the engine where cooling of the NOx controlling component (e.g. the PNA) aids to prevent desorption or release of NOx at a time when the SCR component has not reached its working temperature. Moreover, in cases where the NO2/NOx ratio is larger than 0.5, which typically occurs when the DOC is new or fresh and the temperature of the DOC is above 250° C., cooling of the DOC can adapt the NO2/NOx ration back to about 0.5.

Heating of the NOx controlling component (e.g. DOC or PNA) may be used in order to increase the NO2/NOx ratio, and thereby increase the efficiency of the EATS by assuring that as much NOx as possible is converted through the fast reaction in the SCR. When the catalyst, e.g. present in the DOC or combined DOC and PNA, is new or fresh, heating enables a way to quickly reach or maintain the working temperature of the NOx controlling component, and thus to achieve NO2/NOx ratio of 0.5. This can e.g. be useful after an idle period in which the DOC has been cooled below its optimal temperature but the temperature of the SCR component is above its working temperature. For an aged DOC, heating may be a way to compensate for deactivation which entails a generally lower NO2/NOx ratio.

According to a second aspect of the invention, the object is achieved by an exhaust after treatment system comprising a NOx controlling component according to claim 10. The NOx controlling component comprises inner surface portions defining an interior component space through which exhaust gases is arranged to flow in order to be NOx controlled, and comprises outer surface portions facing away from said interior component space, wherein said exhaust gas after treatment system further comprises a heat transfer arrangement arranged to at least partly surround said NOx controlling component, said heat transfer arrangement being configured to contain a heat transfer medium in order to control the temperature of said NOx controlling component by receiving heat from, or releasing heat to, said outer surface portion of said NOx controlling component.

Effects and features of this second aspect of the present invention are largely analogous to those described above in connection with the first aspect of the inventive concept. Embodiments mentioned in relation to the first aspect of the present invention are largely compatible with the second aspect of the invention, of which some embodiments are explicitly disclosed below.

According to one embodiment, said heat transfer arrangement comprises an inlet for receiving said heat transfer medium, and an outlet for discharging said heat transfer medium such that said heat transfer medium is allowed to flow through said heat transfer arrangement, and wherein said heat transfer arrangement is configured to direct the flow of said heat transfer medium over said outer surface portions in order to receive heat from, or release heat to, said NOx controlling component.

Such heat transfer arrangement may be referred to as a flow heat transfer arrangement as it provides the functionality of allowing the heat transfer medium to flow through the heat transfer arrangement, and thus flow over the outer surface portions of the NOx controlling component. Thus, the inlet may be in fluid connection with any type of cooling means, and/or in fluid connection with any type of heating means. The outlet may e.g. be in fluid connection with the tailpipe of the vehicle.

According to one embodiment, said exhaust gas after treatment system further comprises a selective catalytic reduction unit arranged downstream of said NOx controlling component, and a cooling by-pass channel configured to bleed a sub portion of the exhaust gases downstream of said catalytic reduction unit, and wherein said heat transfer medium is at least partly comprised of said sub portion in order to receive heat from said NOx controlling component.

Thus, an effective but yet relatively cheap way of providing at least a part of the heat transfer means is provided. The cooling by-pass channel is in fluid connection to the inlet of the heat transfer arrangement whereby the sub portion of the exhaust gases are enabled to flow into the heat transfer arrangement via said inlet, over said outer surface portions of said NOx controlling component, and to said outlet.

According to one embodiment, said exhaust gas after treatment system further comprises an air intake configured to receive ambient air, and wherein said heat transfer medium is at least partly comprised of said received ambient air in order to receive heat from said NOx controlling component.

Thus, an effective but yet relatively cheap way of providing at least a part of the heat transfer means is provided. It should be understood that another cooling gas than ambient air may be inserted by the air intake. The air intake is in fluid connection to the inlet of the heat transfer arrangement whereby the ambient air, or another external cooling gas, is enabled to flow into the heat transfer arrangement via said inlet, over said outer surface portions of said NOx controlling component, and to said outlet. The ambient air, or another external cooling gas, may e.g. be mixed with said sub portion of the exhaust gases bled downstream of the NOx controlling component, prior to being subject for heat transfer with said outer surface portions of the NOx controlling component.

According to one embodiment, said exhaust gas after treatment system further comprises a burner configured to heat fluid in a heating line, and, wherein said heat transfer medium is at least partly comprised of said heated fluid in order to release heat to said NOx controlling component.

Additionality or alternatively the heating line may be heat exchanged with the exhaust gas stream upstream of the NOx controlling component, by a heat exchanger, instead of, or as a complement to, using the burner for heating purposes.

That is, the heating fluid is in fluid connection with the inlet of the heat transfer arrangement, and thus said outer surface portions of said NOx controlling component. Thus, an effective but yet relatively cheap way of providing at least a part of the heat transfer means is provided.

According to one embodiment, the EATS comprises means for heating and cooling at least a portion of said NOx controlling component by the heat transfer medium arranged outside of said outer surface portions in said heat transfer arrangement. That is, the means is configured to enable both heating and cooling, either subsequently or simultaneously, for at least a portion of said NOx controlling component by a heat transfer medium arranged outside of said outer surface portions. The choice of heating and/or cooling depends on e.g. the mode of operation of the vehicle and e.g. the type and operational mode of the NOx controlling component. To clarify, the cooling by-pass channel, and the sub portion may be referred to as a first cooling means of the NOx controlling component, the air intake and the ambient air may be referred to as a second cooling means of the NOx controlling component, the burner and the heating line may be referred to as a first heating means of the NOx controlling component, and the heat exchanger and the heating line may be referred to as a second heating means of the NOx controlling component.

According to one embodiment, said heat transfer medium is chosen as a phase change heat transfer medium, and wherein said heat transfer arrangement comprises an expansion vessel configured to compensate for a change in volume of said phase change heat transfer medium as said phase change heat transfer medium undergoes a phase change when receiving heat from, or releasing heat to, said NOx controlling component.

Thus, an alternate way to letting said heat transfer medium flow over said outer surface portions of said NOx controlling component, is provided. Thus, the heat transfer medium has been chosen to be a phase change heat transfer medium, that is, a heat transfer medium which is adapted to the temperature range of the NOx controlling component, and to desired temperature change of the NOx controlling component. For this purpose, the expansion vessel is adapted in size corresponding to the chosen phase change heat transfer medium. For example, when cooling the outer surface portions of the NOx controlling component, the phase change heat transfer medium is chosen such that it undergoes a phase change from solid to liquid, or from liquid to gas form, for the desired temperature change of the oxidation catalyst. Hence, the expansion vessel is used to compensate for the change in volume of the phase change heat transfer medium as it changes from e.g. solid to liquid, or liquid to gas. Correspondingly, for heating the outer surface portions of the NOx controlling component, the phase change heat transfer medium is chosen such that it undergoes a phase change from e.g. liquid to solid, or from gas to liquid form, for the desired temperature change of the oxidation catalyst. Hence, the expansion vessel is used to compensate for the change in volume of the phase change heat transfer medium as it changes from liquid to solid, or gas to liquid form. Such volume expanding or reducing properties in relation to the phase change, and the desired need of cooling or heating, is dependent on the choice of the phase change heat transfer medium and is known to the skilled person. Thus, the expansion vessel is typically adapted to the choice of the phase change heat transfer medium.

According to one embodiment, said NOx controlling component is a diesel oxidation catalyst (DOC) component, or a NOx adsorber, e.g. a passive NOx adsorber (PNA), a lean NOx trap (LNT), or another type of NOx adsorber, as described in relation to the first aspect of the invention.

According to a third aspect of the invention, the object is achieved by a vehicle comprising an exhaust gas after treatment system according to the second aspect of the invention.

Further advantages and advantageous features of the invention are disclosed in the following description and in the dependent claims.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1:
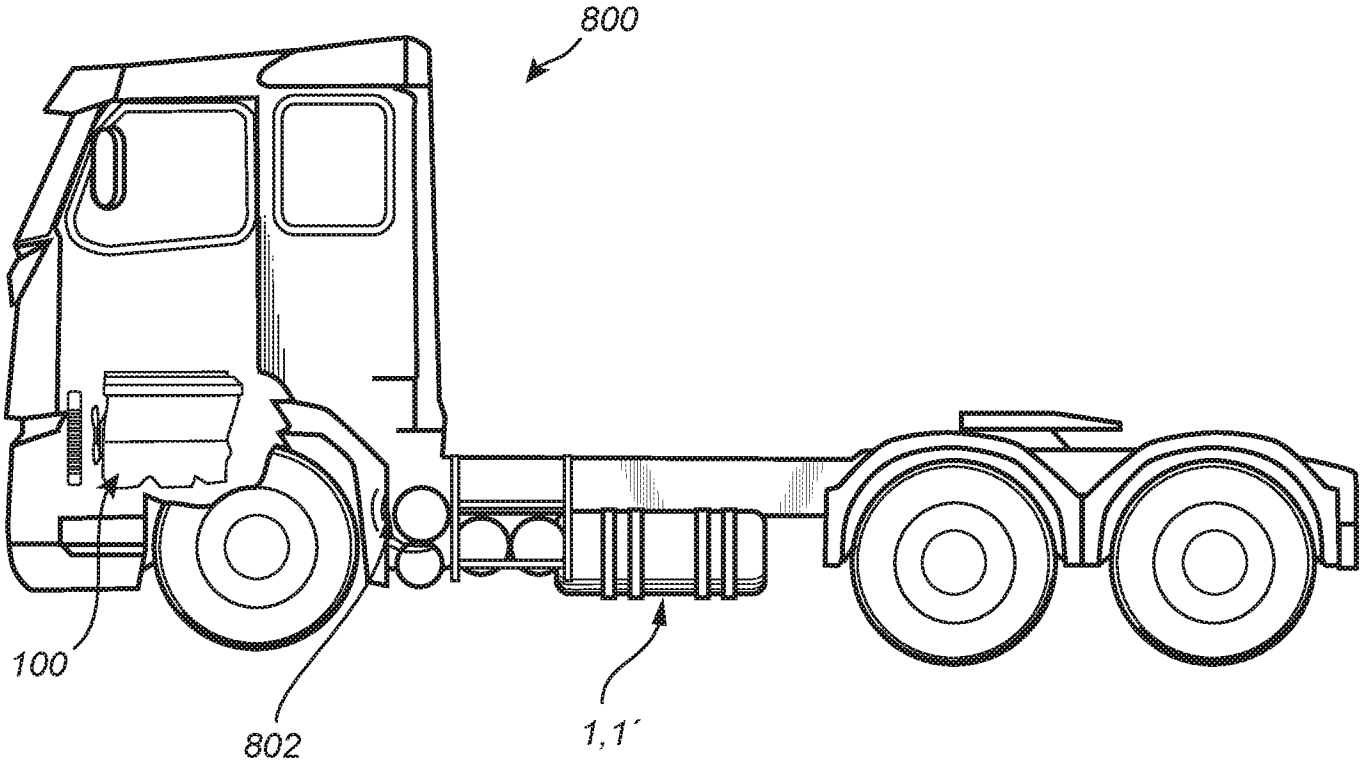
FIG. 1 is a side view of a vehicle comprising an exhaust after treatment system according to an example of the present invention, and a combustion engine.

The present invention will now be described more fully hereinafter with reference to the accompanying drawings, in which an exemplary embodiment of the invention is shown. The invention may, however, be embodied in many different forms and should not be construed as limited to the embodiment set forth herein; rather, the embodiment is provided for thoroughness and completeness. Like reference character refer to like elements throughout the description.

With particular reference to FIG. 1, there is provided a vehicle 800 comprising an exhaust after treatment system (EATS) 1, 1" according to one example of the present invention, and a combustion engine 100, such as an internal combustion engine 100, arranged upstream of, and fluidly connected to, the EATS 1, 1' via pipe 802. The vehicle 800 depicted in FIG. 1 is a truck 800 for which the inventive concept which will be described in detail below, is suitable for.

Figure 2:
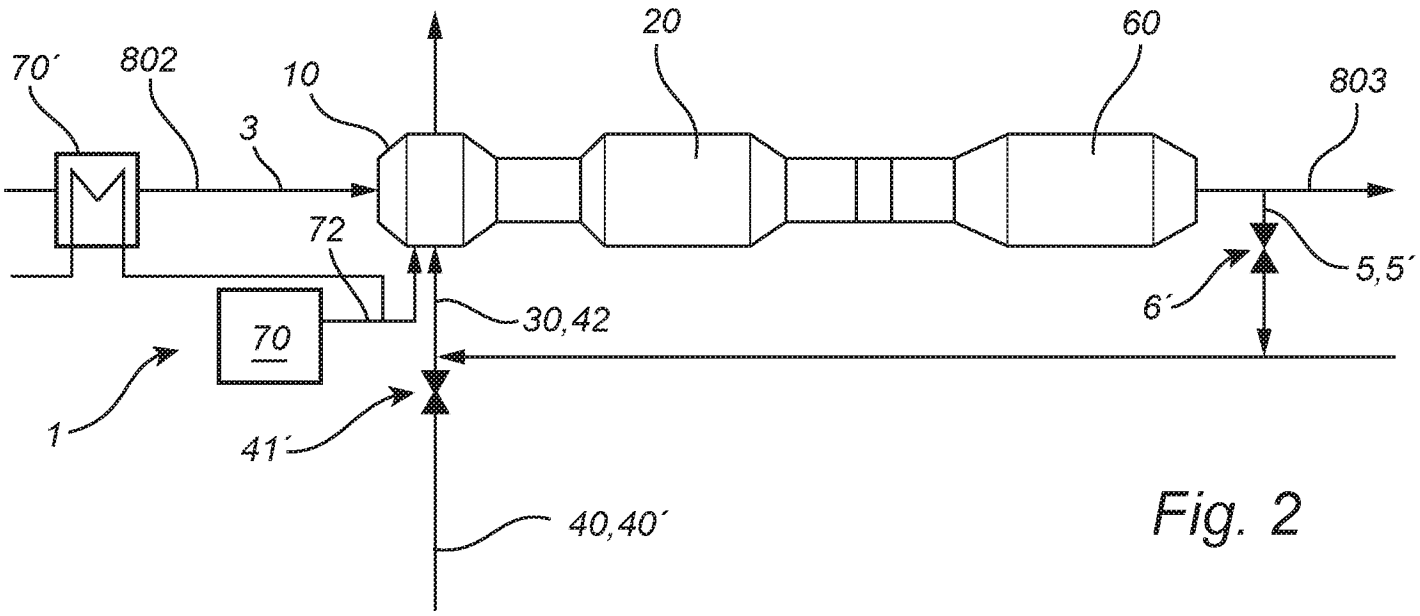
FIG. 2 is a schematic overview of an exhaust after treatment system according to an example of the present invention.

FIG. 2 shows a schematic overview of an EATS 1 in accordance with one embodiment of the invention. In the non-limiting example of FIG. 2, the EATS 1 comprises various components such as a NOx controlling component 10, a filter 20, e.g. a particulate filter for reducing soot content in exhaust gases 3, and a selective catalyst reduction (SCR) component 60. Moreover, the EATS 1 comprises a cooling by-pass channel 5' with a corresponding shut-off valve 6', configured to bleed a sub portion 5 of the exhaust gases 3 downstream of the SCR component 60, and an air intake 40' with a corresponding shut-off valve 41', configured to receive ambient air 40. Both the cooling by-pass channel 5' and the air intake 40' are fluidly connected to the jacket, or outer surface portions, of the NOx controlling component 10 which will be described below. Moreover, in FIG. 2, an optional burner 70 and optional heating line 72 is fluidly connected to the jacket, or outer surface portions, of the NOx controlling component 10 as will be described below.

Figure 3:
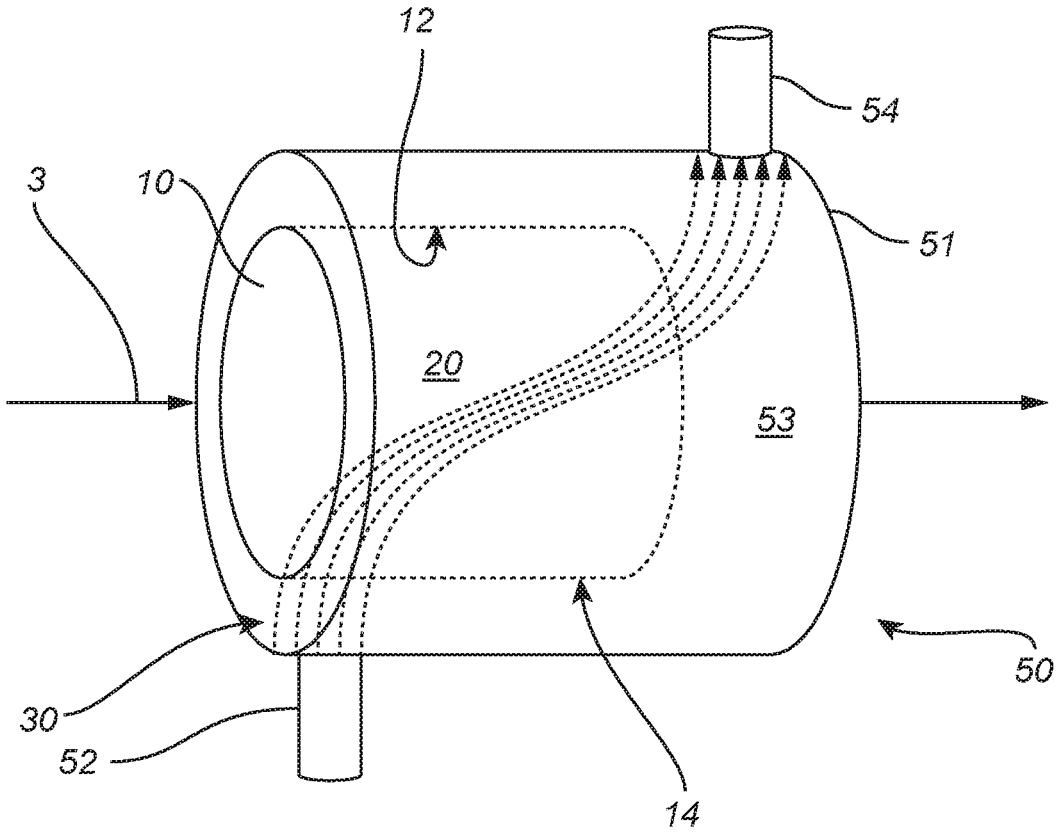
FIG. 3 shows a cross section of a heat transfer arrangement, and a NOx controlling component comprised in an exhaust after treatment system, according to one embodiment of the invention.

Turning to FIG. 3, showing a schematic overview of the NOx controlling component 10 of FIG. 2, and a flow heat transfer arrangement 50. The NOx controlling component 10 comprises inner surface portions 12 defining an interior component space 20 through which exhaust gases 3 is arranged to flow in order to be NOx controlled. The NOx controlling component 10 further comprises outer surface portions 14 facing away from the interior component space 20. The flow heat transfer arrangement 50 is arranged to at least partly surround the NOx controlling component 10, and in FIG. 3, the flow heat transfer arrangement 50 completely surrounds the NOx controlling component 10. The flow heat transfer arrangement 50 is configured to contain a heat transfer medium 30 which may receive heat from, or release heat to, the outer surface portion 14 of the NOx controlling component 10 in order to at least partly control the temperature of the NOx controlling component 10.

In more detail, and as shown in FIG. 3, the flow heat transfer arrangement 50 comprises a heat transfer housing 51, wherein the heat transfer housing 51 defines a heat transfer space 53 which houses the NOx controlling component 10, and contains the heat transfer medium 30. Thus, in the heat transfer space 53, heat transfer is allowed to occur between the outer surface portions 14 of the NOx controlling component 10, and the heat transfer medium 30.

As also shown in the embodiment of FIG. 3, the flow heat transfer arrangement 50 comprises an inlet 52 for receiving the heat transfer medium 30, and an outlet 54 for discharging the heat transfer medium 30. Hereby, the heat transfer medium 30 is allowed to flow through the flow heat transfer arrangement 50, and the heat transfer space 53, in order to exchange heat with the outer surface portions 14 of the NOx controlling component 10 (indicated by arrows in FIG. 3). For this purpose, the inlet 52 is preferably arranged to direct the flow of the heat transfer medium 30 over the outer surface portions 14. According to one embodiment, and as indicated in FIG. 3, the inlet 52 is arranged to direct the flow of the heat transfer medium 30 to an inlet portion of the NOx controlling component 10. Hereby, an effective heat transfer of the NOx controlling component 10 may be achieved. However, it should be noted that the inlet 52 may be arranged at different locations along the length of the NOx controlling component, and/or that more than one inlet (not shown) is arranged in the flow heat transfer arrangement 50.

The function of the EATS 1 will now be described in more detail with reference to FIG. 2 and FIG. 3. The exhaust gases 3, or exhaust gas stream 3, from the engine 100 (shown in FIG. 1) is fed to the EATS 1 by pipe 802 fluidly connected to the NOx controlling component 10. The exhaust gas stream 3 is subsequently passed through the EATS 1, i.e. through the interior component space 20 of the NOx controlling component 10, and subsequently through other components such as the filter 20 and SCR component 60, in order to be cleaned before exiting the EATS 1 via a tailpipe 803. The EATS 1 in FIG. 2 is configured to, in at least one example operational mode, enable cooling of the NOx controlling component 10, by using the sub portion 5 of the cooling by-pass channel 5' and/or using the ambient air 40 received by the air intake 40'. It should be understood that both, or one of, the cooling by-pass channel 5' and air intake 40', may be shut off by the respective shut-off valve 6', 41' in order to control, or even stop, the cooling of the NOx controlling component 10. In the example shown in FIG. 2, the sub portion 5 of the exhaust gases and the ambient air 40 is combined into a cooling stream 42 which is fed to the inlet 52 of the flow heat transfer arrangement 50 whereby it is allowed to flow over the outer surface portions 14 of the NOx controlling component 10 in order to receive heat, and thereby cool the NOx controlling component 10. That is, the EATS 1 in FIG. 2 is configured to utilize the cooling stream 42 as the heat transfer medium 30. Thus, the heat transfer medium in the embodiment shown in FIG. 2 is at least partly comprised of the sub portion and at least partly comprised of the ambient air 40, in order to receive heat from the NOx controlling component 10.

Additionally, or alternatively, the EATS 1 in FIG. 2 is configured to enable heating of the NOx controlling component 10. Thus, for such embodiment the shut-off valves 6', 41' of the cooling by-pass 5 and air intake 40, respectively, are preferably closed. The EATS 1 comprises a burner 70 configured to heat a fluid in the heating line 72, whereby the heated fluid is used to form at least a part of the heat transfer medium 30. Thus, the heated fluid in the heating line 72 is guided to the inlet 52 of the flow heat transfer arrangement 50 and allowed to flow over the outer surface portions 14 of the NOx controlling component 10 in order to release heat to the NOx controlling component 10. Additionality or alternatively the heating line 72 may be heat exchanged with the exhaust gas stream 3 upstream of the NOx controlling component 10, by a heat exchanger 70', instead of, or as a complement to, using the burner 70 for heating purposes.

It should be noted that all of, or only some of, e.g. only one of, the heating and cooling means described in relation to FIG. 2, may be included in the EATS 1. To clarify, the cooling by-pass channel 5, and the sub portion 5 may be referred to as a first cooling means of the NOx controlling component 10, the air intake 40' and the ambient air 40 may be referred to as a second cooling means of the NOx controlling component 10, the burner 70 and the heating line 72 may be referred to as a first heating means of the NOx controlling component 10, and the heat exchanger 70' and the heating line 72 may be referred to as a second heating means of the NOx controlling component 10. For example, the cooling by-pass channel 5 may be omitted (or closed by the shut-off valve 6'), and only the air intake 40 may be used to cool the outer surface portions 14 of the NOx controlling component 10. Correspondingly, the air intake 40' may be omitted (or closed by the shut-off valve 41'), and only the cooling by-pass channel 5 may be used to cool the outer surface portions 14 of the NOx controlling component 10. Likewise, the burner 70, and/or the heat exchanger 70' may be omitted from the EATS, or they may be used separately and be individually shut off depending on the need of the NOx controlling component 10.

Figure 4:
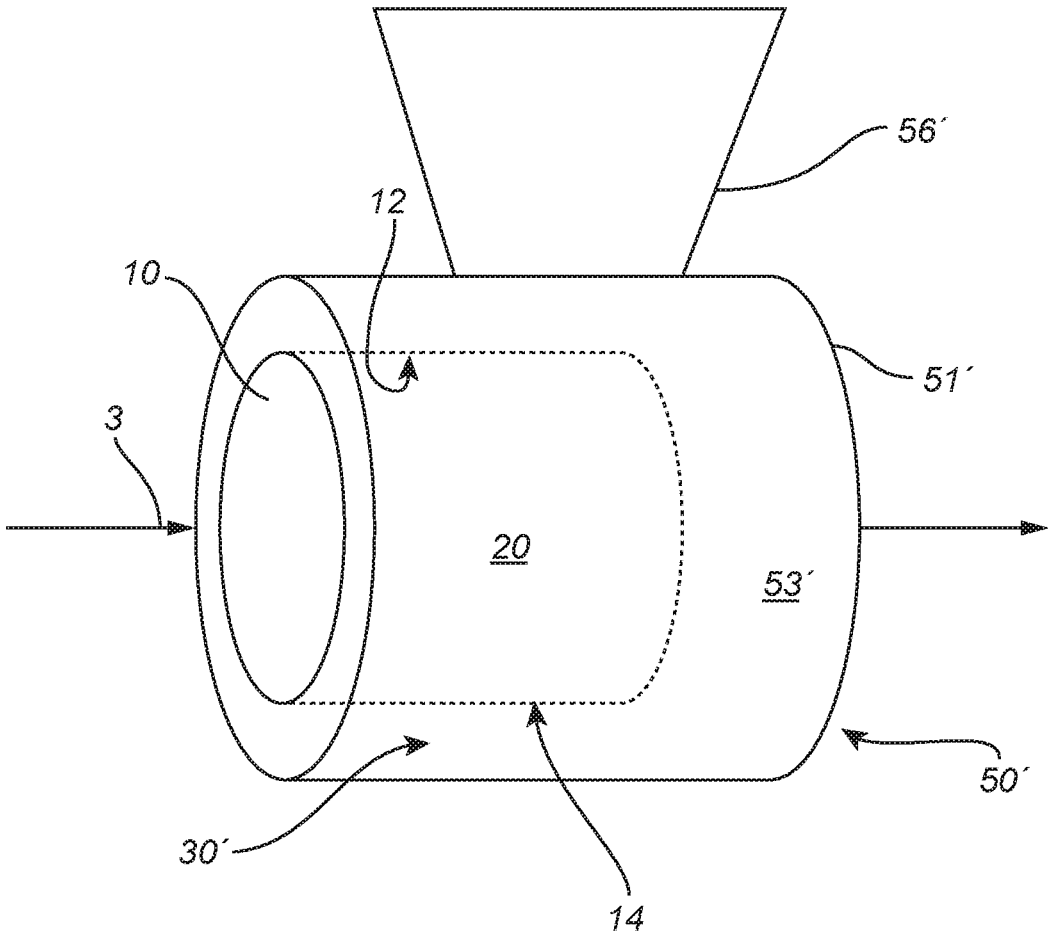
FIG. 4 shows a cross section of a heat transfer arrangement, and a NOx controlling component comprised in an exhaust after treatment system, according to one alternative embodiment of the invention.

Turning to FIG. 4, showing a schematic overview of the NOx controlling component 10 of FIG. 2 and FIG. 3, and an expansion heat transfer arrangement 50'. The NOx controlling component 10 in FIG. 4 is identical with the one described with reference to FIG. 3, and the features are not described here again, but same reference numerals are used for corresponding features. The expansion heat transfer arrangement 50' is arranged to at least partly surround the NOx controlling component 10, and in FIG. 4, the expansion heat transfer arrangement 50' completely surrounds the NOx controlling component 10. The expansion heat transfer arrangement 50' is configured to contain a heat transfer medium 30' which may receive heat from, or release heat to, the outer surface portion 14 of the NOx controlling component 10 in order to at least partly control the temperature of the NOx controlling component 10.

In more detail, and as shown in FIG. 4, the expansion heat transfer arrangement 50' comprises a heat transfer housing 51', wherein the heat transfer housing 51' defines a heat transfer space 53' which houses the NOx controlling component 10, and contains the heat transfer medium 30'. The contained heat transfer medium 30' is chosen as a phase change heat transfer medium 30', meaning that the properties of the heat transfer medium 30' is chosen such that the heat transfer medium 30' will undergo a phase change when receiving heat from, or releasing heat to, the outer surface portions 14 of the NOx controlling component 10. Thus, the phase change heat transfer medium 30' is adapted to the temperature range of the NOx controlling component 10 and to the desired temperature change of the NOx controlling component 10. Thus, in the heat transfer space 53', heat transfer is allowed to occur between the outer surface portions 14 of the NOx controlling component 10, and the phase change heat transfer medium 30'.

As also shown in the embodiment of FIG. 4, the expansion heat transfer arrangement 50' comprises an expansion vessel 56' configured to compensate for a change in volume of the phase change heat transfer medium 30' as it undergoes a phase change when receiving heat from, or releasing heat to, the NOx controlling component 10. For this purpose, the expansion vessel 56' is adapted in size corresponding to the chosen phase change heat transfer medium 30'.

The function of the expansion heat transfer arrangement 50' will now be described in further detail. For cooling the outer surface portions 14 of the NOx controlling component 10, the phase change heat transfer medium 30' is chosen such that it undergoes a phase change from solid to liquid, or from liquid to gas form, for the desired temperature change of the oxidation catalyst. Hence, the expansion vessel 56' is used to compensate for the change in volume of the phase change heat transfer medium as it changes from e.g. solid to liquid, or liquid to gas. Correspondingly, for heating the outer surface portions 14 of the NOx controlling component 10, the phase change heat transfer medium is chosen such that it undergoes a phase change from e.g. liquid to solid, or from gas to liquid form, for the desired temperature change of the oxidation catalyst. Hence, the expansion vessel 56' is used to compensate for the change in volume of the phase change heat transfer medium as it changes from liquid to solid, or gas to liquid form. Such volume expanding or reducing properties in relation to the phase change, and the desired need of cooling or heating, is dependent on the choice of the phase change heat transfer medium 30' and is known to the skilled person. Thus, the expansion vessel 56' is typically adapted to the choice of the phase change heat transfer medium 30'.

Figure 5:
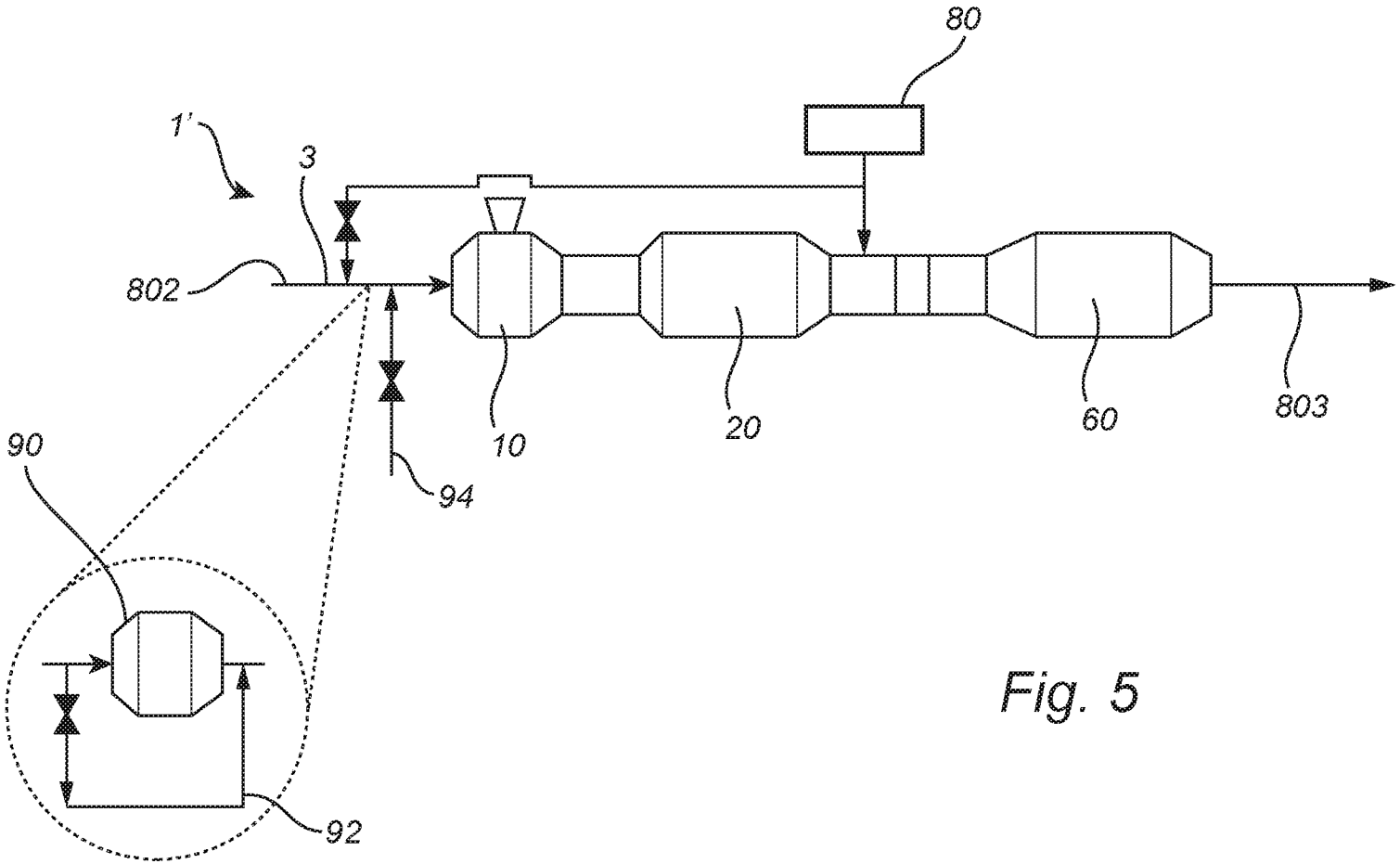
FIG. 5 is a schematic overview of an exhaust after treatment system according to an example of the present invention.

FIG. 5 shows an EATS 1' similar to the EATS 1 of FIG. 2, thus the same reference numerals are used for corresponding features, and are not described in detailed again for FIG. 5. Moreover, the function of the EATS 1' is similar to the function of the EATS 1 of FIG. 2, especially concerning the flow of exhaust gases 3 through the EATS 1', why this is not described in detail again. However, the EATS 1' of FIG. 5 comprises the expansion heat transfer arrangement 50' described with reference to FIG. 4 instead of the flow heat transfer arrangement 50 described with reference to FIG. 3. Thus, both heating and cooling of the outer portions 14 of the NOx controlling component 10 is possible with the expansion heat transfer arrangement 50', depending on the choice of the phase change heat transfer medium 30', as described with reference to FIG. 4, and thus the cooling by-pass channel 5', the air intake 40' and the heating line 72 may be omitted.

As shown in FIG. 5, the EATS 1' comprises an optional exhaust gas burner 80, and a turbo unit 90 arranged upstream of the NOx controlling component 10. The exhaust gas burner 80 may be used to heat the exhaust gases 3 prior to entering the NOx controlling component 10 and/or to heat the exhaust gases after the NOx controlling component 10, and the turbo unit 90 may be provided with a turbo by-pass channel 92, enabling hot exhaust gases to by-pass the turbo unit 90 and thus heat the exhaust gases 3 prior to entering the NOx controlling component 10.

As also shown in FIG. 5 the EATS 1' comprises an optional cooling line 94, e.g. fed with ambient air, configured for direct cooling of the exhaust gases 3 prior to the NOx controlling component 10. Thus, the cooling line 94 may be used to cool the exhaust gases 3 prior to entering the NOx controlling component 10.

The heating and/or cooling means of the exhaust gases shown in FIG. 5, i.e. the burner 90 and/or the turbo unit 90 with turbo by-pass channel 92, and/or the cooling line 94 shown in FIG. 5 is applicable to the EATS 1 of FIG. 2 as well.

Figure 6:
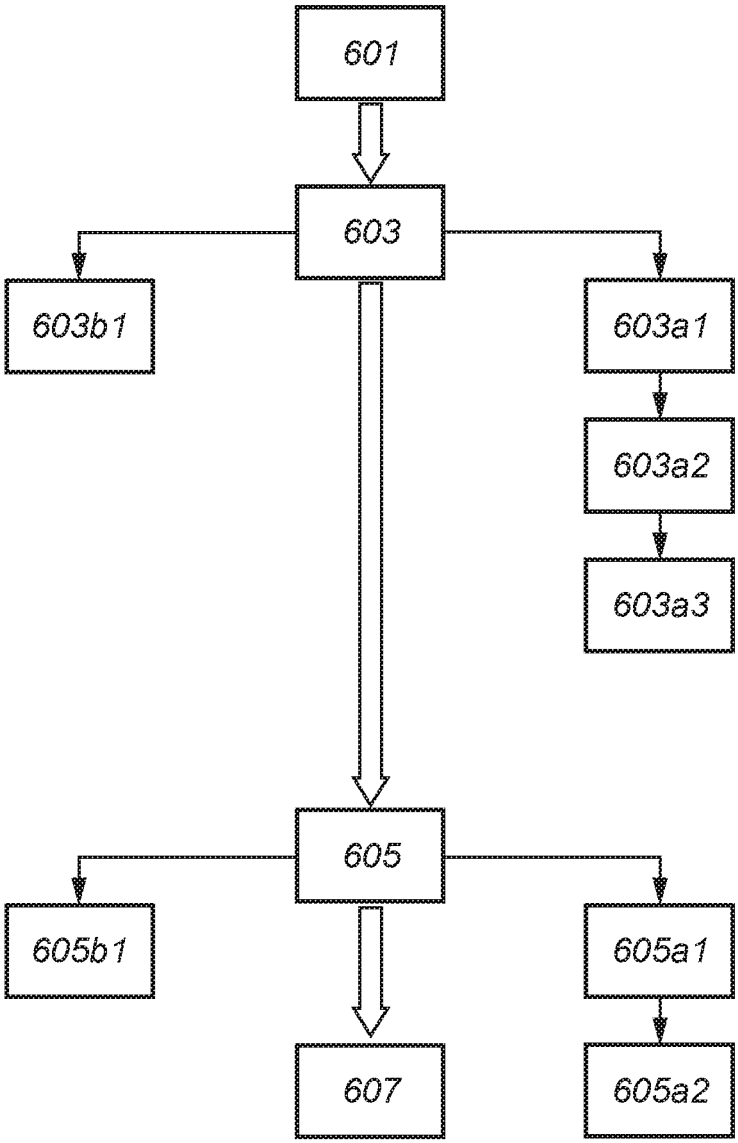
FIG. 6 is a flow-chart showing steps of a method for controlling the temperature of a NOx controlling component according to one embodiment of the invention.

The invention will now be described with reference to a method for controlling the temperature of a NOx controlling component 10 in an exhaust after treatment system, EATS 1, 1' as those described in FIG. 2 and FIG. 5. The method is described in the flow-chart of FIG. 6 and reference numerals used in FIGS. 1-5 will be used throughout the description of the flow-chart in FIG. 6, when referring to corresponding features.

In a first step 601 of the method, the temperature of at least a portion of the NOx controlling component 10 is controlled by the heat transfer medium 30, 30' arranged outside of the outer surface portions 14 of the NOx controlling component 10. Thus, the heat transfer medium 30, 30' is arranged to release heat to, or receive heat from, the NOx controlling component 10 via the outer surface portions 14.

In a second step 603, the first step 601 of controlling the temperature comprises cooling at least a portion of the NOx controlling component 10 by the heat transfer medium 30, 30'. That is, the second step 603 comprises cooling at least a portion of the NOx controlling component 10, by receiving heat from the outer surface portions 14.

Below, different alternative steps are described which relates to either the use of the flow heat transfer arrangement 50, or to the expansion heat transfer arrangement 50'. In more detail, first and third alternative steps are related to the use of the flow heat transfer arrangement 50, and second and fourth alternative steps are related to the use of the expansion heat transfer arrangement 50'.

In a first alternative first step **603*a*1, the second step 603 of cooling comprises directing a flow 40 of the heat transfer medium 30 to flow over the outer surface portions of the NOx controlling component 10. Thus, the heat transfer medium 30 may receive heat from the NOx controlling component 10 as it flows over the outer surface portions 14**.

In a first alternative second step **603*a*2, a sub portion 5 of the exhaust gases downstream of the NOx controlling component 10 is bled, and said sub portion is used to form at least a part of the heat transfer medium 30**.

In a first alternative third step **603*a*3, which may be carried out additionally to, or as an alternative to, the first alternative second step 603*a*2, external cooling gas such as e.g. ambient air 40 is used to form at least a part of the heat transfer medium 30**.

In a second alternative first step **603*b*1, the second step 603 of cooling comprises receiving heat from the NOx controlling component 10 by a phase change of the heat transfer medium 30'. This step 603*b*1 is typically preceded by a step of choosing a heat transfer medium as a phase change heat transfer medium adapted to the desired temperature change of the NOx controlling component 10**.

In a third step 605, which may be carried out additionally to, or as an alternative to, the second step 603, the first step 601 of controlling the temperature comprises heating at least a portion of the NOx controlling component 10 by the heat transfer medium 30, 30'.

In a third alternative first step **605*a*1, the third step 605 of heating comprises directing a flow 40 of the heat transfer medium 30 to flow over the outer surface portions of the NOx controlling component 10. Thus, the heat transfer medium 30 may release heat to the NOx controlling component 10 as it flows over the outer surface portions 14**.

In a third alternative second step **605*a*2, a fluid in a heating line is heated by a burner, and the heated fluid is used to form at least a part of the heat transfer medium 30**.

In a fourth alternative first step **605*b*1, the third step 605 of heating comprises receiving releasing heat to the NOx controlling component 10 by a phase change of the heat transfer medium 30'. This step 605*b*1 is typically preceded by a step of choosing a heat transfer medium as a phase change heat transfer medium adapted to the desired temperature change of the NOx controlling component 10**.

In a fourth optional step 607, the NOx controlling component 10 is heated by adding heat to the exhaust gases 3 upstream of the NOx controlling component 10. This may e.g. be carried out by using a burner or a turbo by-pass channel.

It should be understood that the NOx controlling component 10 in the EATS 1, 1' described herein may for example be a diesel oxidation catalyst (DOC) component, or a NOx adsorber, e.g. a passive NOx adsorber (PNA), a lean NOx trap (LNT), or another type of NOx adsorber.

Moreover, it should be noted that the EATS 1, 1' shown in FIG. 1 may correspond to any one of the described EATS 1, 1' in FIG. 2, and FIG. 5.

It is to be understood that the present invention is not limited to the embodiments described above and illustrated in the drawings; rather, the skilled person will recognize that many changes and modifications may be made within the scope of the appended claims.

The invention claimed is:

1. A method for controlling the temperature of a NOx controlling component in an exhaust after treatment system of an internal combustion engine, said NOx controlling component having inner surface portions defining an interior component space through which exhaust gases are arranged to flow in order to be NOx controlled, and having outer surface portions facing away from said interior component space, the method comprising: controlling the temperature of at least a portion of said NOx controlling component by a heat transfer medium arranged outside of said outer surface portions, herein the heat transfer medium comprises gas that has been obtained in accordance with the following:

bleeding a sub portion of the exhaust gases downstream of said NOx controlling component.

2. The method according to claim 1, wherein said step of controlling the temperature comprises directing a flow of said heat transfer medium to flow over said outer surface portions of said NOx controlling component.

3. The method according to claim 1, wherein said step of controlling the temperature comprises cooling at least a portion of said NOx controlling component by said heat transfer medium.

4. The method according to claim 1, wherein said step of controlling the temperature comprises heating at least a portion of said NOx controlling component by said heat transfer medium.

5. The method according to claim 4, comprising the further step of heating a fluid in a heating line by a burner, and using said heated fluid to form at least a part of said heat transfer medium.

6. The method according to claim 1, wherein said step of controlling the temperature comprises receiving heat from, or releasing heat to, said NOx controlling component by a phase change of said heat transfer medium.

7. The method according to claim 1 where said NOx controlling component is a diesel oxidation catalyst, DOC component, or a NOx adsorber, e.g. a passive NOx adsorber, PNA, a lean NOx trap, LNT, or another type of NOx adsorber.

8. An exhaust after treatment system comprising an NOx controlling component having inner surface portions defining an interior component space through which exhaust gases is arranged to flow in order to be NOx controlled, and having outer surface portions facing away from said interior component space, said exhaust gas after treatment system further comprising a heat transfer arrangement arranged to at least partly surround said NOx controlling component, said heat transfer arrangement being configured to contain a heat transfer medium in order to control the temperature of said NOx controlling component by receiving heat from, or releasing heat to, said outer surface portion of said NOx controlling component, wherein said heat transfer arrangement comprises an inlet for receiving said heat transfer medium, and an outlet for discharging said heat transfer medium such that said heat transfer medium is allowed to flow through said heat transfer arrangement, and wherein said heat transfer arrangement is configured to direct the flow of said heat transfer medium over said outer surface portions in order to receive heat from, or release heat to, said NOx controlling component, the exhaust gas after treatment system further comprises a selective catalytic reduction unit arranged downstream of said NOx controlling component, and a cooling by-pass channel configured to bleed a sub portion of the exhaust gases downstream of said catalytic reduction unit, and wherein said heat transfer medium is at least partly comprised of said sub portion in order to receive heat from said NOx controlling component.

9. The exhaust gas after treatment system according to claim 8, further comprising a burner configured to heat fluid in a heating line, and, wherein said heat transfer medium is at least partly comprised of said heated fluid in order to release heat to said NOx controlling component.

10. The exhaust gas after treatment system according to claim 8, wherein said heat transfer medium is chosen as a phase change heat transfer medium, and wherein said heat transfer arrangement comprises an expansion vessel configured to compensate for a change in volume of said phase change heat transfer medium as said phase change heat transfer medium undergoes a phase change when receiving heat from, or releasing heat to, said NOx controlling component.

11. The exhaust gas after treatment system according to claim 8, wherein said NOx controlling component is a diesel oxidation catalyst, DOC component, or a NOx adsorber, e.g. a passive NOx adsorber, PNA, a lean NOx trap, LNT, or another type of NOx adsorber.

12. A vehicle comprising an exhaust gas after treatment system according to claim 8.

* * * * *